US007992551B2

(12) United States Patent
Shieh

(10) Patent No.: US 7,992,551 B2
(45) Date of Patent: Aug. 9, 2011

(54) OIL CAPTURING DEVICE HAVING A ROTARY COMPONENT

(75) Inventor: Tenghua Tom Shieh, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 434 days.

(21) Appl. No.: 12/323,546

(22) Filed: Nov. 26, 2008

(65) Prior Publication Data

US 2010/0126480 A1 May 27, 2010

(51) Int. Cl.
*F01M 1/00* (2006.01)

(52) U.S. Cl. ..... 123/572

(58) Field of Classification Search ..... 123/572–574, 123/41.86; 55/401

See application file for complete search history.

(56) References Cited

U.S. PATENT DOCUMENTS

| | | | | |
|---|---|---|---|---|
| 6,394,078 | B1 | 5/2002 | Kling et al. | |
| 6,439,174 | B1 | 8/2002 | Shea et al. | |
| 6,709,477 | B1 * | 3/2004 | H.ang.kansson et al. | 55/401 |
| 6,973,925 | B2 * | 12/2005 | Sauter et al. | 123/572 |
| 7,717,101 | B2 * | 5/2010 | Beetz et al. | 123/572 |
| 2003/0140909 | A1 | 7/2003 | Criddle et al. | |
| 2005/0000496 | A1 | 1/2005 | Norrick | |
| 2005/0061305 | A1 | 3/2005 | Pietschner | |
| 2006/0048761 | A1 | 3/2006 | Ekeroth et al. | |
| 2006/0090738 | A1 | 5/2006 | Hoffmann et al. | |

FOREIGN PATENT DOCUMENTS

| | | |
|---|---|---|
| DE | 19947143 | 4/2001 |
| DE | 102005003113 | 8/2005 |
| EP | 0730086 | 9/1996 |
| GB | 710510 | 6/1954 |
| GB | 1035542 | 7/1966 |
| JP | 59077040 | 5/1984 |
| JP | 9144524 | 6/1997 |
| JP | 2002242650 | 8/2002 |

* cited by examiner

*Primary Examiner* — M. McMahon
(74) *Attorney, Agent, or Firm* — Gifford, Krass, Sprinkle, Anderson & Citkowski, P.C.

(57) ABSTRACT

An oil capturing device for capturing oil from crankcase gases. The oil capturing device includes a housing containing a central chamber and a rotor disposed in the central chamber. The rotor includes a shaft rotatable about an axis and a flange extending from the shaft towards the inner wall of the central chamber. The flange is in contact with the inner wall, and spirals along the shaft so as to define a gas passage interconnecting the inlet to the first port. The gas passage provides a passage for crankcase gases to flow from the inlet to the first port, and narrows as it proceeds from the inlet to the port so as to compress crankcase gases travelling from the inlet to the first port. The rotor may be operable by a motor, pulley connected to the engine, or a turbine driven by the engine's exhaust.

15 Claims, 3 Drawing Sheets

OIL CAPTURING DEVICE HAVING A ROTARY COMPONENT

FIELD OF THE INVENTION

The invention relates to an oil separating device for separating oil from engine gases. More particularly, the invention relates to an oil separating device including a rotor having a shaft a flange spiraling along the shaft so as to define a gas passage. The gas passage narrows so as to compress the crankcase gases and facilitate the capture of oil.

BACKGROUND OF THE INVENTION

An internal combustion engine includes a combustion chamber, where a fuel air mixture is burned to cause movement of a set of reciprocating pistons, and a crankcase, which contains the crankshaft driven by the pistons. During operation, it is normal for the engine to experience "blow-by," wherein combusted engine gases leak past the piston-cylinder gap from the combustion chamber and into the crankcase. These blow-by or crankcase gases contain moisture, acids and other undesired by-products of the combustion process.

It is normal for crankcase gases to also include a very fine oil mist. The oil mist escapes from the engine to the manifold. The oil mist is then carried from the manifold back into the combustion chamber along with the fuel/air mixture. This results in an increase in oil consumption. Additionally the combustion of the oil mist causes a build-up of residuals in the combustion chamber and on pistons which over time decreases engine efficiency. An engine typically includes a Positive Crankcase Ventilation (PCV) system for removing these harmful gases from the engine and prevents those gases from being expelled into the atmosphere. It is known to incorporate an oil separating device in a PCV system to remove oil from these crankcase gases. It is known to use manifold vacuum to draw crankcase gases into localized high velocity areas of the oil separator to promote separation of oil from the gases. The oil is re-introduced back to a sump via a drain device which is located generally at the bottom of the oil separator to allow for gravity to assist the drainage of oil. The sump generally holds excess oil in the system.

However, during certain engine operating conditions such as when the engine is operating at a wide open throttle, there is not enough manifold vacuum to draw the crankcase gases. Accordingly some oil separating devices use auxiliary power to draw the crankcase gases. For instance, some oil separating devices use a centrifugal oil separator to draw crankcases gases and separate the oil from those gases. Such devices use a rotary component driven by a motor or a turbo transmission. However the such centrifugal oil separators do not capture oil, rather oil is separated from the crankcase gases and collected. Yet other oil separating devices with a rotary component include a shaft and a spiraling member spiraling along the shaft. The spiraling component defines a uniformly shaped passage interconnecting the inlet to an outlet. The cyclone effect created by these devices thrusts the crankcase gases against a wall whereby the oil is separated oil from crankcase gases. Such devices do not compress the crankcase gases, rather the separated oil is splattered against and collects on the inner wall of the housing and drains to the engine.

However, micron and sub-micron particles of oil remain in the crankcase gases. Accordingly, it remains desirable to provide an improved device that is more efficient than conventional oil separator designs in capturing micron and sub-micron particles of oil from crankcase gases while at the eliminating reliance upon manifold vacuum to draw crankcases gases.

SUMMARY OF THE INVENTION

According to one aspect of the invention, an oil capturing device is provided for capturing oil from crankcase gases. The oil capturing device includes a housing containing a central chamber. The central chamber includes an inner wall, a first port interconnecting the central chamber to the housing, and a rotor. The rotor includes a shaft rotatable about an axis and a flange extending from the shaft towards the inner wall of the central chamber. The flange includes a distal edge in contact with the inner wall. The flange spirals along the shaft so as to define a gas passage interconnecting the inlet to the first port. The gas passage provides a passage for crankcase gases to flow from the inlet to the first port, and the gas passage narrows as it proceeds from the inlet to the port so as to compress crankcase gases as these gases travel from the inlet to the first port. The compressed gas is drawn through the first port where oil is captured from the compressed gas, and wherein the captured oil drains into an oil drain and the filtered crankcase gases are drawn an outlet. Crankcase gases are drawn through the central chamber by having the rotor spin. The rotor may be operable by a motor, pulley connected to the engine, or a turbine driven by the engine's exhaust.

DETAILED DESCRIPTION OF THE INVENTION

Figure 1:
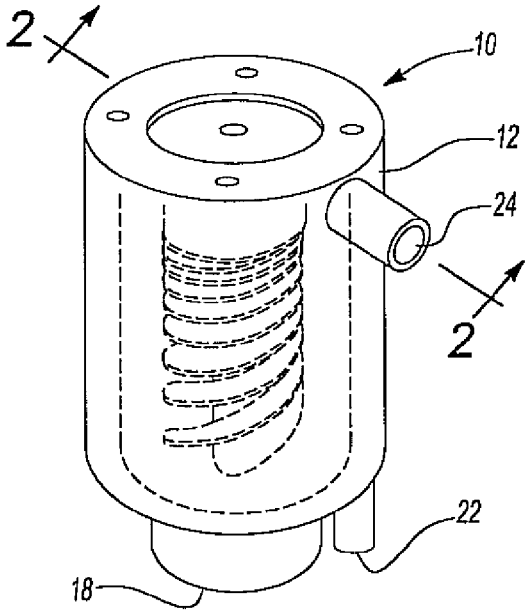
FIG. 1 is a perspective view of an embodiment of an oil capturing device.
Figure 2:
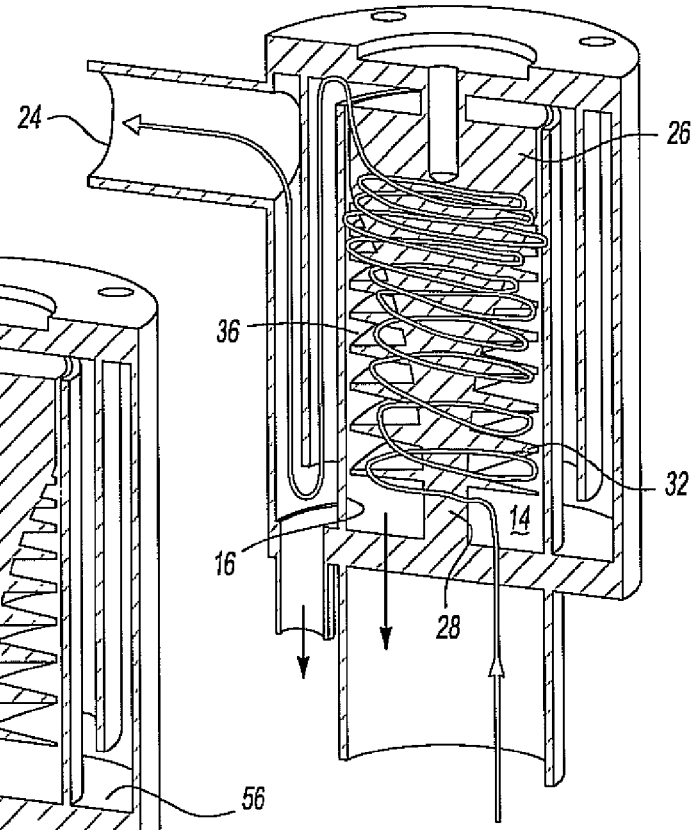
FIG. 2 is a cross-sectional view of taken along lines 2-2, the figure includes arrow 39 showing the path of crankcase gases proceeding through the device, and arrows 41 showing captured oil draining into the oil sump.
Figure 3:
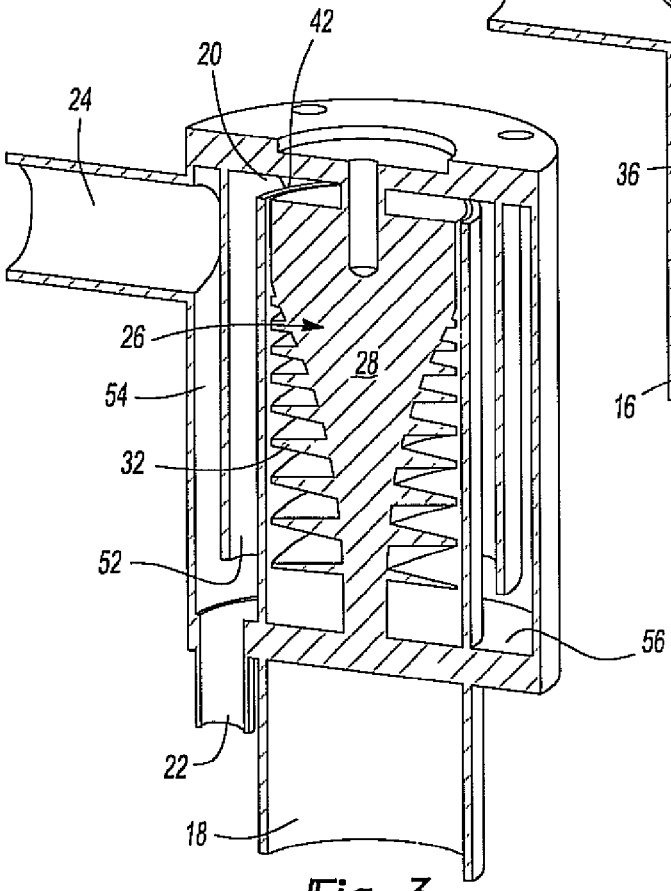
FIG. 3 is a view of FIG. 2 without the arrows.
Figure 4:
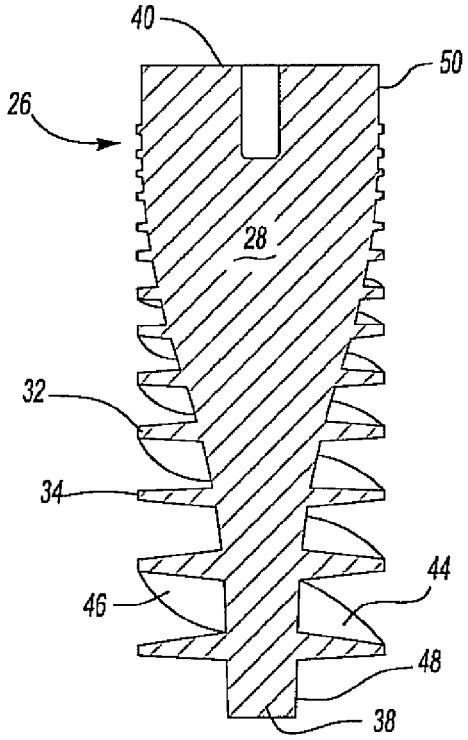
FIG. 4 is a cross-sectional view of the rotor, showing the gas passage narrowing as the gas passage proceeds from the inlet to the first port.

Referring to the Figures, wherein like numerals indicate corresponding parts throughout the several views, an oil capturing device 10 for capturing oil from crankcase gases is provided. With reference to FIGS. 1-3, the oil capturing device 10 includes a housing 12 containing a central chamber 14. The central chamber 14 has an inner wall 16 and includes an inlet 18 interconnecting the engine with the central chamber 14. The inlet 18 provides a passage for crankcase gases to be drawn into the central chamber 14. A first port 20 interconnects the central chamber 14 to the housing 12. The housing 12 further includes an oil drain 22 interconnecting the housing 12 with the engine, and an outlet 24 interconnecting the housing 12 with the engine intake.

With reference now to FIGS. 1-5, a rotor 26 is disposed in the central chamber 14 between the inlet 18 and the first port 20. The rotor 26 includes a shaft 28 rotatable about an axis 30 and a flange 32 extending from the shaft 28 towards the inner wall 16 of the central chamber 14. The flange 32 includes a distal edge 34 wherein at least a portion of the distal edge 34 is in contact with the inner wall 16 of the central chamber 14. The flange 32 spirals along the shaft 28 so as to define a gas passage 36 interconnecting the inlet 18 to the first port 20. Specifically, the gas passage 36 is defined by the space between the shaft 28, flange 32, and inner wall 16. The gas passage 36 provides a passage for crankcase gases to flow from the inlet 18 to the first port 20. The shaft 28 includes a first end portion 38 opposite a second end portion 40. The first end portion 38 is adjacent to the inlet 18 and a second end portion 40 adjacent to the first port 20. The gas passage 36 narrows as it proceeds from the first end portion 38 to the second end portion 40 so as to compress crankcase gases as it travels from the inlet 18 to the first port 20. The compressed gas is drawn through the first port 20 and into a punching and impact plate 42, where oil is captured from the compressed crankcase gas. The captured oil then drains into the oil drain 22 and the filtered crankcase gases are drawn into the outlet 24.

As stated above, the gas passage 36 is defined by the space between the shaft 28, flange 32 and the inner wall 16 of the central chamber 14 as indicated by the hollowed arrow in FIG. 2. The flange 32 further includes an upper surface 44 spaced apart and opposite a lower surface 46. The distal edge 34 interconnects the upper surface 44 to the lower surface 46, and as the flange 32 spirals from the inlet 18 to the outlet 24. The upper surface 44 faces the lower surface 46 so as to define the gas passage 36, and the distance between an upper surface 44 and a facing lower surface 46 decreases as the flange 32 proceeds from the inlet 18 to the first port 20. Thus, the gas passage 36 narrows and the crankcase gases are compressed by the time the gases reach the first port 20. It is anticipated that the pitch of the flange 32 may be adjusted so as to deliver a desired amount of crankcase gases or affect the compression rate and pressure of those gases. For instance, the flange 32 may spiral around the shaft 28 only two times, thus decreasing the pressure of the compressed crankcase gas.

With reference again to FIG. 2, the gas passage 36 is also narrowed by having the shaft 28 widen as the shaft 28 proceeds from the inlet 18 to the first port 20. Specifically, the first end portion 38 of the shaft 28 has a first peripheral edge 48 and the second end portion 40 has a second peripheral edge 50 larger than the first peripheral edge 48. Thus as the shaft 28 widens, the gas passage 36 narrows. It is anticipated that other configurations may be used to narrow the gas passage 36, and the illustrations presented herein are not limiting.

With reference again to FIGS. 2 and 3, a first preferred embodiment of oil capturing device 10 is provided. Specifically, the housing 12 further includes a mid-chamber 52 partially enclosing the central chamber 14 and an outer chamber 54 partially enclosing the mid-chamber 52. The oil drain 22 is disposed on the mid-chamber 52, and the first port 20 interconnects the central chamber 14 with the mid-chamber 52. A second port 56 interconnects the mid-chamber 52 to the outer chamber 54, and the outlet 24 interconnects the outer chamber 54 with the engine intake. The first port 20 is disposed above the second port 56 so as to promote the drainage of captured oil into the oil drain 22 and the flow of filtered crankcase gases into the outlet 24. The oil drain 22 is disposed above and in communication with the engine sump (not shown) so as to allow captured oil to drain back into the engine and be recycled. The outlet 24 is in communication with the engine manifold (not shown) so as to provide for recirculation of the crankcase gases.

Figure 7:
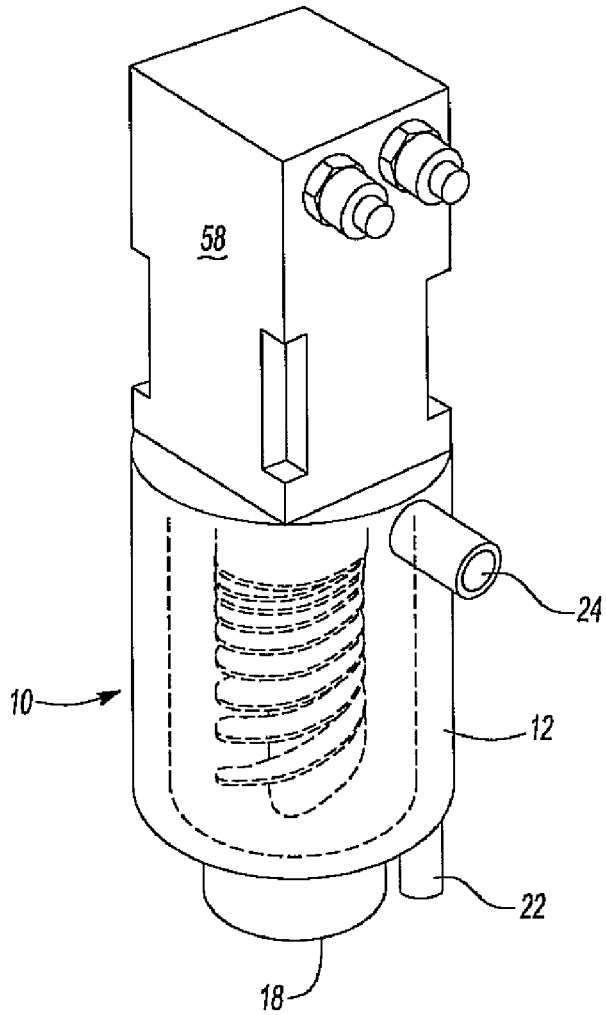
FIG. 7 is a figure of the oil capturing device operable by a motor.

It is anticipated that the rotor 26 may be spun by a motor 58, pulley 60, or turbine 62. With reference now to FIG. 7 a motor 58 is attached to the rotor 26. The motor 58 may be connected to the vehicle's battery (not shown) and may be controlled by a sensor 59 (not shown) that detects the vacuum pressure in the engine's intake. Thus, when the sensor 59 detects that the vacuum pressure falls below a predetermined amount the sensor 59 actuates the motor 58 so as to cause the rotor 26 to spin. The spinning of the rotor 26 in turn causes the crankcase gases to be drawn from the engine, and draws the crankcase gases along the gas passage 36, whereby the crankcase gases are compressed and then captured as described above. Preferably the motor 58 may spin the rotor 26 at RPM (revolutions per minute). It is anticipated that the speed of the motor 58 may continuously varied so as to maintain a steady pressure level across the oil capturing device 10. Thus, as the vacuum pressure varies in the intake or across the oil capturing device 10, the motor 58 speed may also vary. Such motors 58 and sensors are known. For instance, the rotor 26 may be driven by a brushless servo motor and a static pressure transducer type sensor may be used to control the motor 58 and monitor the vacuum pressure in the vehicle manifold.

Figure 8:
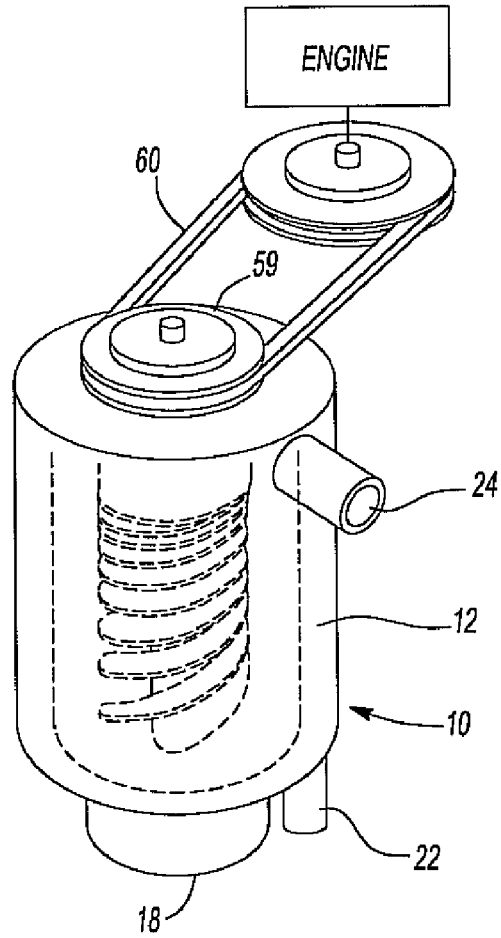
FIG. 8 is a figure of the oil capturing device operable by a pulley that is driven by the engine.

With reference now to FIG. 8 a pulley 60 is attached to the rotor 26. Specifically, the rotor 26 includes a pin 59 and the pulley 60 is mounted to the pin 59 so as to rotate the pin 59 thereby rotating the rotor 26. The pulley 60 is driven by the engine and is operable to rotate the rotor 26. The pulley 60 may be engaged and disengaged from the engine by a configuration of gears (not shown). Furthermore, the RPM of the rotor 26 may be controlled by changing the pulley ratio. Thus, like the motor 58, the pulley 60 may be adjusted so as to maintain a steady pressure level across the oil separating device.

Figure 6:
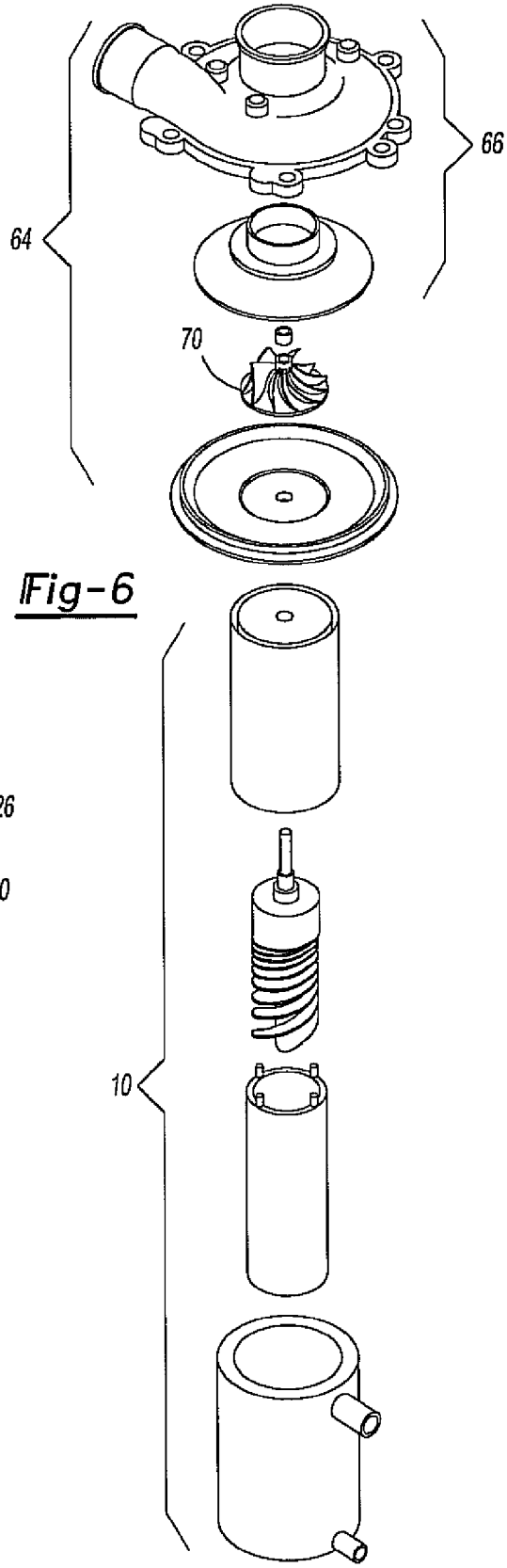
FIG. 6 is an exploded view of the oil capturing device operable by a turbine.
Figure 5:
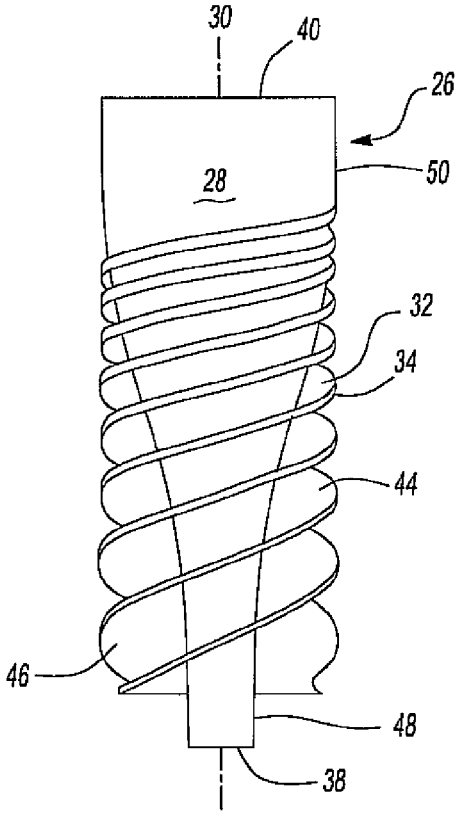
FIG. 5 is a perspective view of FIG. 4 showing the distance between the upper surface and lower surface decreasing, and the shaft widening as the gas passage proceeds from the inlet to the first port.

With reference now to FIG. 6 a turbine assembly 64 fixedly connected to rotor 26 so as to spin the rotor 26. The turbine assembly 64 includes a turbine housing 66 having a housing inlet 68 that interconnects the turbine assembly 64 to the vehicle's exhaust system. The turbine assembly 64 further includes a turbine blade 70 rotatably housed within the turbine housing 66. Exhaust is used to turn the turbine blade 70 and thus rotate the rotor 26. Thus crankcase gases are always drawn from the engine so long as the engine is operating.

Obviously, many modifications and variations of the present invention are possible in light of the above teachings and may be practiced otherwise than as specifically described while within the scope of the appended claims.

What is claimed is:

1. An oil capturing device for capturing oil from crankcase gases, the oil capturing device comprising:

a housing containing a central chamber having an inner wall, the central chamber includes an inlet interconnecting the engine with the central chamber so as to allow crankcase gases to be drawn into the central chamber, an oil drain interconnecting the housing with the engine, and an outlet interconnecting the housing with the engine intake;

a first port interconnecting the central chamber to the housing so as to allow crankcase gases and captured oil to flow from the central chamber into the housing;

and a rotor disposed in the central chamber between the inlet and the first port, the rotor having a shaft rotatable about an axis and a flange extending from the shaft towards the inner wall of the central chamber, the flange includes a distal edge at least partially in contact with the inner wall, wherein the flange spirals along the shaft so as to define a gas passage interconnecting the inlet to the first port, the gas passage providing a passage for crankcase gases to flow from the inlet to the first port and wherein the gas passage narrows as it proceeds from the first end portion to the second end portion so as to compress crankcase gases as it travels from the inlet to the first port, and wherein the compressed gas is drawn through the first port where oil is captured from the compressed gas, and wherein the captured oil drains into the oil drain and the filtered crankcase gases are drawn into the outlet.

2. An oil capturing device as set forth in claim 1 wherein the housing further includes a mid-chamber partially enclosing the central chamber and an outer chamber partially enclosing the mid-chamber, and wherein the oil drain is disposed on the mid-chamber, and the outlet interconnects the outer chamber with the engine intake.

3. An oil separator as set forth in claim 2 further including a second port interconnecting the mid-chamber to the outer chamber, wherein the first port is disposed above the second port when the oil capturing device is mounted to an engine.

4. An oil capturing device as set forth in claim 3 wherein the oil drain is disposed above and in communication with the engine sump so as to allow captured oil to drain back into the engine and be recycled.

5. An oil capturing device as set forth in claim 4 wherein the outlet is in communication with the engine manifold so as to provide for recirculation of the crankcase gases.

6. An oil capturing device as set forth in claim 1 further including a motor operable to rotate the rotor.

7. An oil capturing device as set forth in claim 1 further including a pulley operable to rotate the rotor, wherein the pulley is driven by the engine.

8. An oil capturing device as set forth in claim 7 further including a pin fixedly mounted to the rotor, and wherein the pulley is mounted to the pin and an engine so as to rotate the rotor.

9. An oil capturing device as set forth in claim 1 further including a turbine assembly fixedly connected to rotor so as to spin the rotor.

10. An oil capturing device as set forth in claim 9 further including a turbine housing having a housing inlet interconnected to the exhaust of the vehicle, and wherein exhaust gas is used to rotate the turbine.

11. An oil capturing device as set forth in claim 1 wherein the shaft includes a first end portion adjacent to the inlet, and a second end portion opposite the first end and adjacent to the first port.

12. An oil capturing device as set forth in claim 11 wherein the first end portion has a first peripheral edge and the second end portion has a second peripheral edge larger than the first peripheral edge, the shaft widening as it proceeds from the first end portion to the second end portion.

13. An oil capturing device as set forth in claim 1 wherein the flange further includes an upper surface spaced apart and opposite a lower surface, and the distal edge interconnects the upper surface to the lower surface, wherein the gas passage is defined by the space between the lower surface and the upper surface, and wherein the space between the lower and upper surface decreases as the flange proceeds from the first end portion to the second end portion.

14. An oil capturing device for separating oil from crankcase gases, the oil capturing device comprising:

a housing containing a central chamber having an inner wall, the central chamber includes an inlet interconnecting the engine with a central chamber so as to allow crankcase gases to be drawn from the engine into the central chamber, an oil drain interconnecting the housing with the engine, and an outlet interconnecting the housing with the engine intake;

a first port interconnecting the central chamber to the housing so as to allow crankcase gases and captured oil to flow from the central chamber into the housing;

a rotor disposed in the central chamber between the inlet and the first port, the rotor having:

a shaft rotatable about an axis and a flange extending from the shaft towards the inner wall of the central chamber;

the flange includes an upper surface spaced apart and opposite a lower surface, and a distal edge interconnecting the lower surface to the upper surface, and wherein the distal edge is at least partially in contact with the inner wall, and wherein the flange spirals along the shaft so as to define a gas passage for crankcase gases to flow through the first port into the housing;

the shaft includes a first end portion opposite a second end portion, the first end portion is adjacent to the inlet and the second end portion is adjacent to the first port, and the first end portion has a first peripheral edge and the second end portion has a second peripheral edge that is larger than the first peripheral edge such that the shaft widens as it proceeds from the first end portion to the second end portion; and a gas passage defined by the space between the lower surface, the upper surface, shaft, and inner wall, wherein the space decreases as the flange proceeds from the first end portion to the second end portion so as to compress crankcase gases as it travels within the gas passage; and an actuator for rotating the rotator, wherein the actuator is one selected from the group consisting of a motor, pulley driven by the engine, and a turbine.

15. An oil capturing device for capturing oil from crankcase gases, the oil capturing device having a housing containing a central chamber having an inner wall the central chamber includes an inlet interconnecting the engine with the central chamber so as to allow crankcase gases to be drawn into the central chamber, an oil drain interconnecting the housing with the engine, an outlet interconnecting the housing with the engine intake, and a first port interconnecting the central chamber to the housing so as to allow crankcase gases and captured oil to flow from the central chamber into the housing, said oil capturing device comprising:

a rotor disposed in the central chamber between the inlet and the first port, the rotor having a shaft rotatable about an axis and a flange extending from the shaft towards the inner wall of the central chamber, the flange includes a distal edge at least partially in contact with the inner wall, wherein the flange spirals along the shaft so as to define a gas passage interconnecting the inlet to the first port, the gas passage providing a passage for crankcase gases to flow from the inlet to the first port and wherein the gas passage narrows as it proceeds from the first end portion to the second end portion so as to compress crankcase gases as it travels from the inlet to the first port, and wherein the compressed gas is drawn through the first port where oil is captured from the compressed gas, and wherein the captured oil drains into the oil drain and the filtered crankcase gases are drawn into the outlet.

* * * * *

UNITED STATES PATENT AND TRADEMARK OFFICE

CERTIFICATE OF CORRECTION

PATENT NO. : 7,992,551 B2
APPLICATION NO. : 12/323546
DATED : August 9, 2011
INVENTOR(S) : Tenghua Tom Shieh It is certified that error appears in the above-identified patent and that said Letters Patent is hereby corrected as shown below:

In the Specification:
In column 2, line 25, delete “drawn an”, insert --drawn to an--
In column 2, line 27, delete “motor, pulley”, insert --motor, a pulley--
In column 4, line 4, delete “62”, insert --64--
In the Claims:
In column 4, line 54, delete “the engine”, insert --an engine--
In column 4, line 57, delete “with the”, insert --with an--
In column 5, line 4, delete “from the”, insert --from a--
In column 5, line 6, delete “gases”, insert --gas--
In column 5, line 12, delete “An oil”, insert --The oil--
In column 5, line 19, delete “An oil separator”, insert --The oil capturing device--
In column 5, line 22, delete “an engine”, insert --the engine--
In column 5, line 23, delete “An oil”, insert --The oil--
In column 5, line 27, delete “An oil”, insert --The oil--
In column 5, line 28, delete “the engine”, insert --an engine--
In column 5, line 30, delete “An oil”, insert --The oil--
In column 5, line 32, delete “An oil”, insert --The oil--

Signed and Sealed this
Thirteenth Day of August, 2013

Teresa Stanek Rea
*Acting Director of the United States Patent and Trademark Office*